US006460380B1

(12) United States Patent
Sciacca et al.

(10) Patent No.: US 6,460,380 B1
(45) Date of Patent: Oct. 8, 2002

(54) METHOD FOR PRODUCING TRIDIMENSIONAL KNITTED GOODS

(75) Inventors: Franco Sciacca, Cassina Rizzardi; Tiberio Lonati, Brescia, both of (IT)

(73) Assignee: Franco Sciacca (IT)

( * ) Notice: Subject to any disclaimer, the term of this patent is extended or adjusted under 35 U.S.C. 154(b) by 0 days.

(21) Appl. No.: 09/787,336

(22) PCT Filed: Sep. 6, 1999

(86) PCT No.: PCT/IT99/00282

§ 371 (c)(1),
(2), (4) Date: Mar. 13, 2001

(87) PCT Pub. No.: WO00/14316

PCT Pub. Date: Mar. 16, 2000

(30) Foreign Application Priority Data

Sep. 10, 1998 (IT) ..... C098A0016

(51) Int. Cl.[7] ..... D04B 9/54

(52) U.S. Cl. ..... 66/21

(58) Field of Search ..... 66/8, 17, 21, 173, 66/13, 27, 18, 19

(56) References Cited

U.S. PATENT DOCUMENTS

| | | | | | |
|---|---|---|---|---|---|
| 4,005,494 | A | * | 2/1977 | Burn | 66/178 |
| 4,038,699 | A | * | 8/1977 | Burn | 66/178 |
| 5,321,959 | A | * | 6/1994 | Mitsumoto | 66/178 |
| 6,065,311 | A | * | 5/2000 | Essig et al. | 66/178 |

* cited by examiner

*Primary Examiner*—Danny Worrell
(74) *Attorney, Agent, or Firm*—Robert F. I. Conte; Lee, Mann, Smith, McWilliams, Sweeney & Ohlson

(57) ABSTRACT

The invention relates to a method for producing knitted goods in general, hose in particular, with tridimensional effects or shaped goods, preferably fitted with at least one pocket automatically produced with the continuous motion of the needle cylinder. The usual knitted fabric production is modified by excluding, according to a preestablished order, sequences of needles (retaining the last loop or stitch) that are preferably alternated (1:1-2:2-3:1-etc.), even by groups. The knitted tube production goes on, even over several courses, with a differentiated growing, i.e. regions having full needles or ribs and regions having non-full needles or ribs, forming knitted layers or tubes (5, 6) concentric with the inner knitted tube folded upwardly and only partly interstitched or closed in the horizontal direction. The remaining part, which is open, corresponds to the two-layer pouch-like pocket, being the object of the invention.

13 Claims, 4 Drawing Sheets

FIG. 1
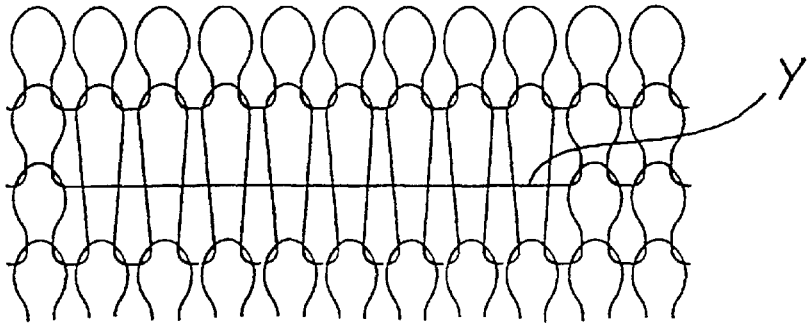
FIG. 2
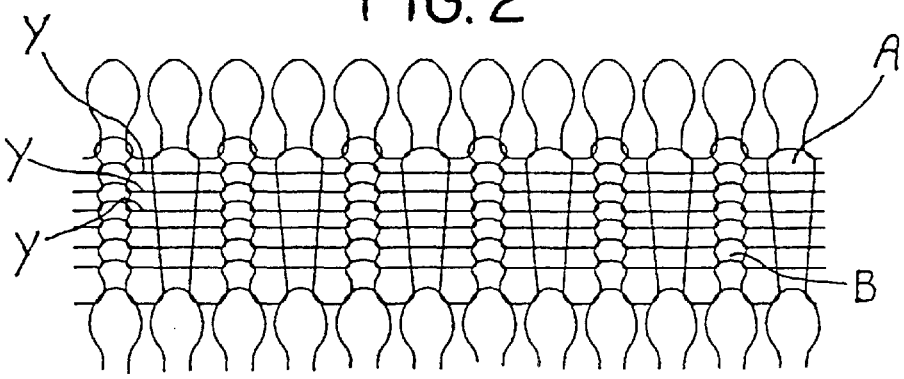
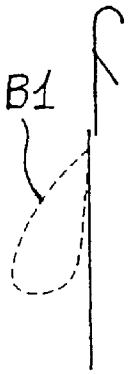
FIG. 2a
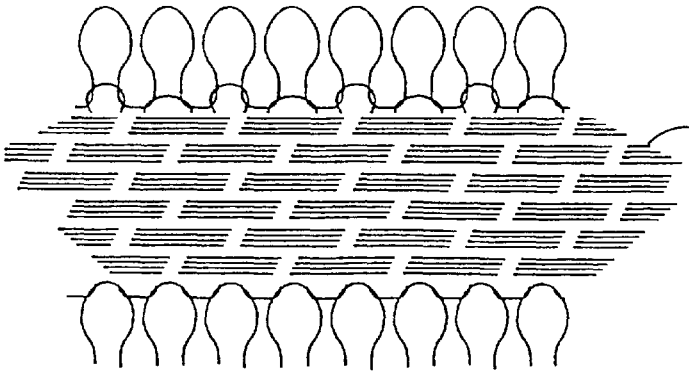
FIG. 3
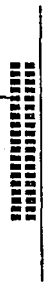
FIG. 3a FIG.4
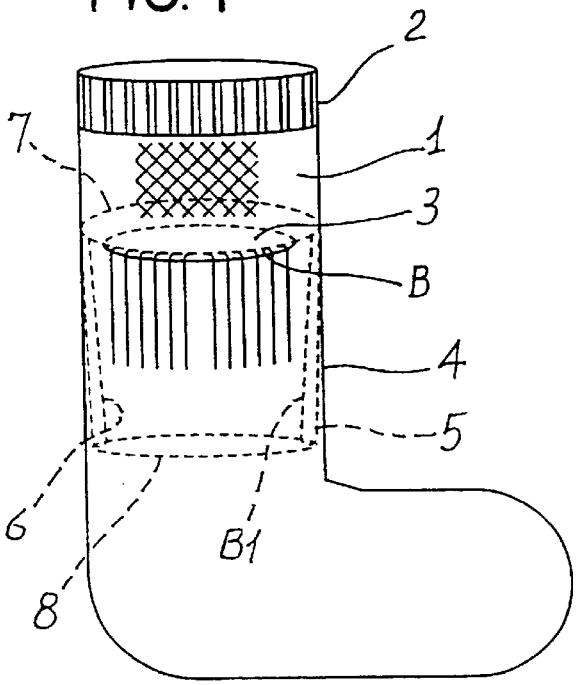
FIG.5
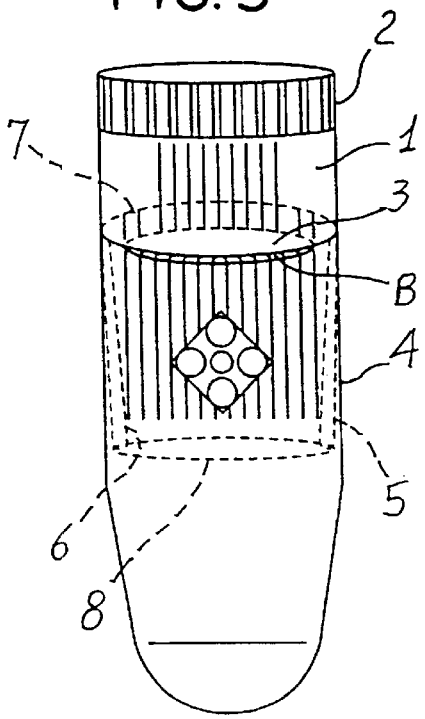
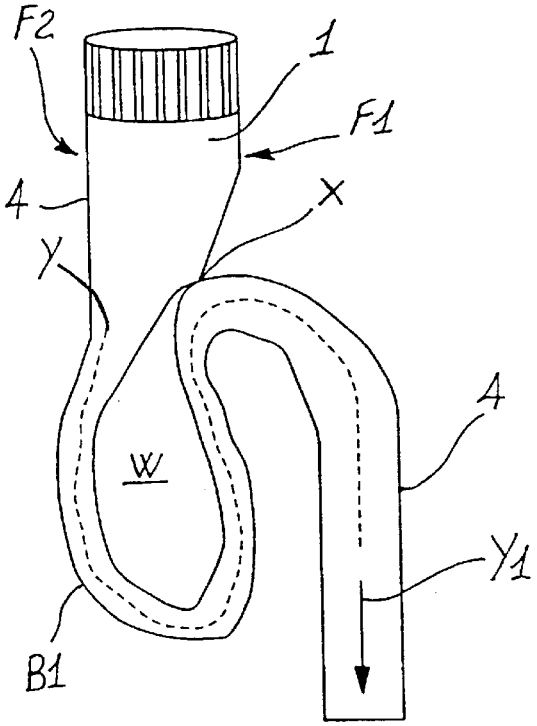
FIG.6
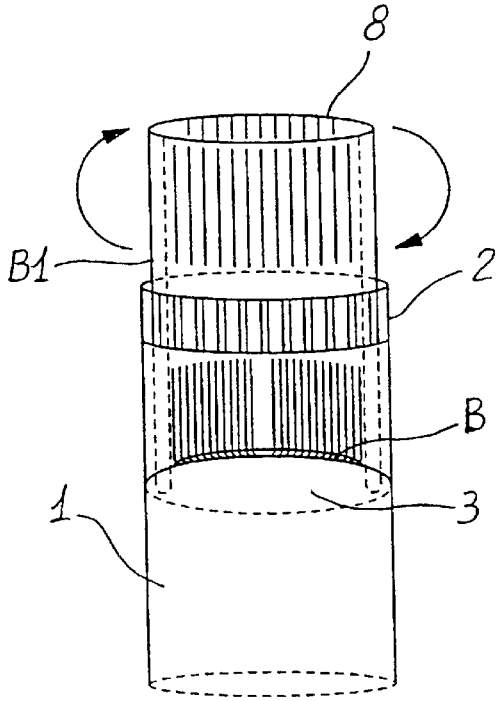
FIG.7

FIG. 8
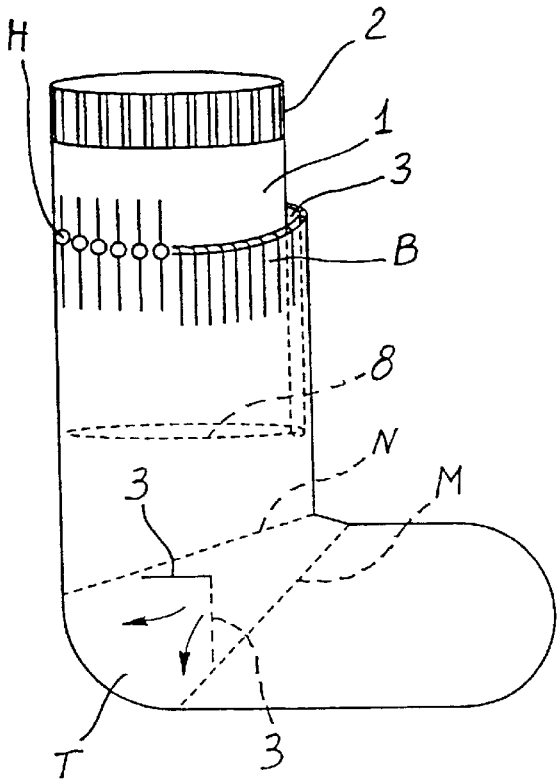
FIG. 9
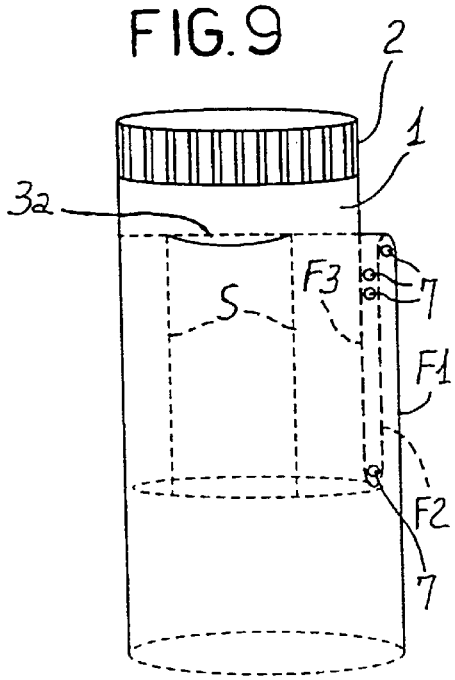
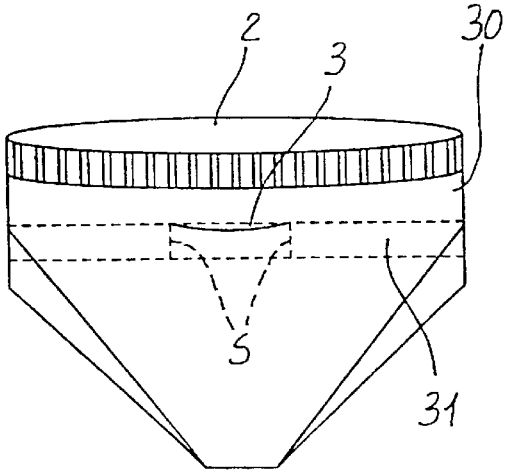
FIG. 10
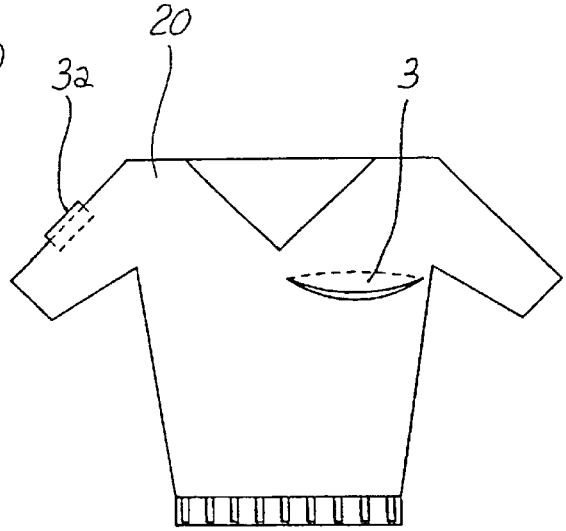
FIG. 11

FIG. 12
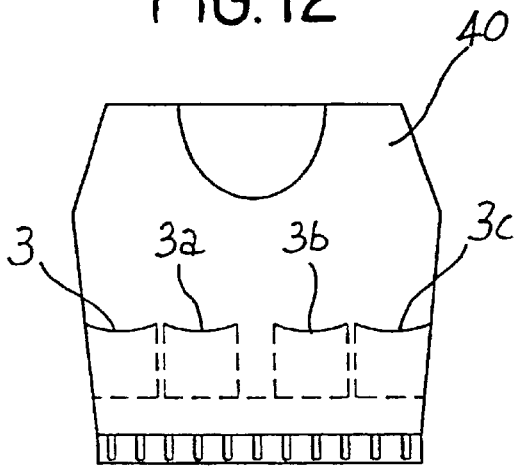
FIG. 13
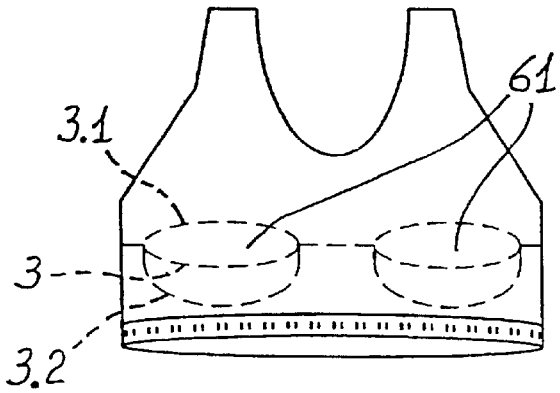
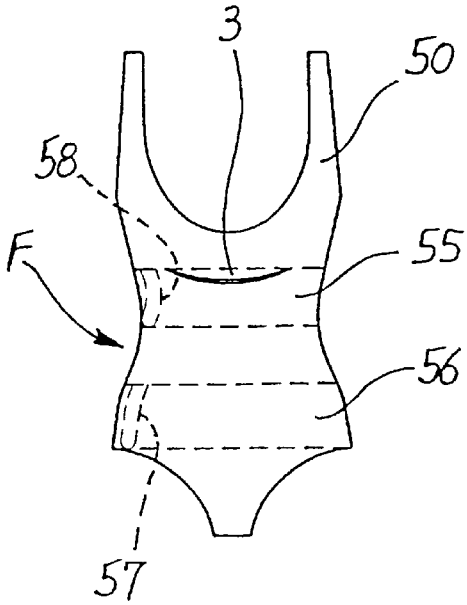
FIG. 14
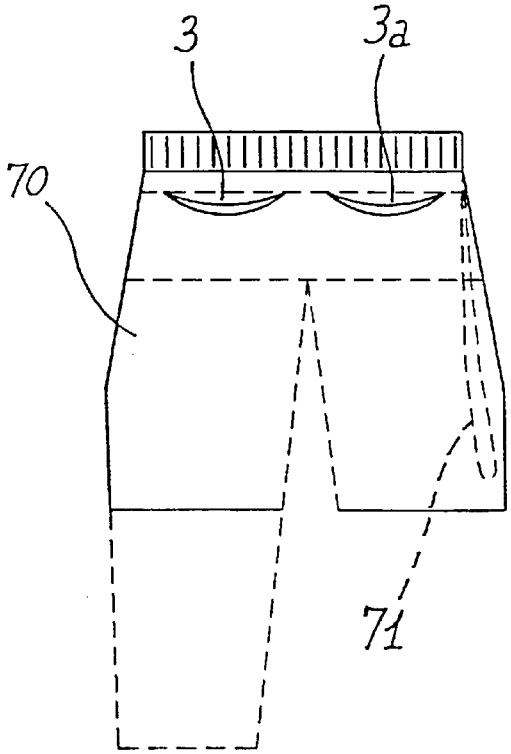
FIG. 15

METHOD FOR PRODUCING TRIDIMENSIONAL KNITTED GOODS

FIELD OF THE INVENTION

The present invention relates to a method for producing tridimensional knitting goods.

BACKGROUND ART

Generally, with circular knitting and hosiery machines, efficient and aesthetically appreciable effects of tridimensional tricot are only obtained with the reciprocating movement of the cylinder needle, but this method greatly increases production costs. Alternatively, in the case of hose with the so-called pouch heel, which is known to those skilled in the art, the method enables similar results to be achieved, but with a significant loss in quality and yarn due to the presence of a great number of cut threads. More generally, in order to increase the value of some knitted goods, during the manufacturing process, various pockets or loops are added by subsequent cut and sew operation, so that the cost of the finished articles is greatly increased.

In addition, in the hosiery field, the presence of pockets or similar horizontal openings is widely unknown.

In everyday as well as in sports activities, are often required or necessary garments that are adapted to protect from impacts (shinpads in football, for example) or that are capable of meeting a higher standard in terms of practical use and comfort (such as multi-pocket jackets for hiking people, fishermen and hunters, or containers for golf clubs) and satisfying other needs of an aesthetic or functional character.

Taking into account the great development in the clothing field for sports and free time, knitted garments in general, socks in particular, have enjoyed little consideration as a possible support for innovations or more interesting functions; they are, yet, mere single-fabric or single-layer knitted tubes supplied with an elastic top: thus they still represent a mere or fortuitous thin wall between foot and shoe.

SUMMARY OF THE INVENTION

In recent years great interest was awakened when circular knitting machines of the full electronic type with differentiated diameters were introduced on the market, because the versatility of these machines enables a wide variety of semifinished knitted goods to be produced: brassieres, pants, dresses, trousers, skirts, bodies, bathing costumes, sports garments and still others. But, due to some inherent technical restrictions, among which lack of pockets, said knitted goods require additional labourious sewing operations for garment finishing. Otherwise, they merely remain without pockets and consequently less competitive.

That being stated, the invention intends to reduce or at least partly eliminate some of the above mentioned technical and production limits; with a production method having original economic, technical, aesthetic and commercial aims.

Consequently, it is a main object of the present invention to provide a method for producing knitted goods in general, hose in particular, having tridimensional effects, preferably fitted with at least one pocket automatically produced with the continuous movement of the cylinder needle. It is a further object of the invention to provide a method for producing knitted goods in general, socks in particular, also characterized by the presence of pockets formed of at least two layers or cloths, even adapted to be partly turned inside out.

It is an additional object of the invention to provide a method for producing knitted goods such as brassieres, pants, woollen underwear and knitwear, skirts, pants and technical items in general, characterized by the presence of at least one pocket or pouch. Another main object of the invention is to provide a method for producing knitted goods with at least one flounce formed of multi layers or fabrics and having the function of an inner lining.

The above mentioned objects are substantially achieved by a method for producing knitted goods, characterized by automatically producing on said goods at least one open pocket of multy-layer fabrics obtained with the continuous motion of a needle bed and with a prolonged but temporary and programmed exclusion of a suitable number of needles.

Further features of the invention and the advantages resulting therefrom will be more fully understood from the following description of some preferred but not exclusive embodiments of a method according to the invention now given by way of non-limiting example. The description will be taken with reference to the accompanying drawings in which:

BRIEF DESCRIPTION OF THE DRAWINGS

FIG. 1 shows a structure of jersey knitted fabric material provided with a floating yarn;

FIG. 2 shows a knitted fabric obtained by working needles alternated with excluded needles;

FIG. 2*a* shows a closed knitted flounce formed by two layers of cloths;

FIG. 3 is a front view of a knitted fabric provided with a series of short floating yarns;

FIG. 3*a* is a sectional view of the fabric of FIG. 3;

FIG. 4 shows a side view of a sock obtained with the method of the present invention;

FIG. 5 is a front view of another sock obtained with the present method;

FIG. 6 shows a front view of the sock of FIG. 4 turned inside out;

FIG. 7 shows a tubular fabric with an alternative form of pocket;

FIG. 8 shows a side view of a sock having a pocket as wide as half the needle cylinder;

FIG. 9 shows in a more schematically way the pocket of FIG. 8;

FIG. 10 shows a pair of knitted pants provided with a pocket;

FIG. 11 shows a sweater provided with a pocket;

FIG. 12 shows a sweater provided with a series of pockets;

FIG. 13 shows a brassiere provided with two pockets;

FIG. 14 shows a body stocking with outer and inner pockets;

FIG. 15 shows a skirt or a pair of trousers provided with two side pockets.

DESCRIPTION OF THE PREFERRED EMBODIMENT

The invention relates to a method which can find application in the field of the textile machines in general, and of knitting and of circular machines in particular.

Most of the description is made with reference to an essentially circular machine equipped with at least one needle bed or a cylinder rotating against stationary cams or vice versa, with at least one complete feed and therefore provided with: one or more yarn feeders; electronic or mechanical, or electromechanical needle selection, adapted to control the elements taking part in formation of the stitch or knitted fabric according to a pattern or working cycle.

Said circular knitting machine is additionally equipped with at least one dial provided with needles or hooks preferably to be selected by an electronic system or with the aid of usual cams adapted to select the jacks or needles butts, conveniently arranged. The invention is first embodied by preparing a jacquard pattern or motif, or information directed to the needles or jacks or other elements taking part in tricot formation, by a control or memory device or by electromechanical, magnetic, optical apparatus, or any other apparatus adapted for the purpose.

Contrary to the custom, an important part of said pulses or information is not sent to the needles or part of them, according to a defined scheme or program and according to the original pattern. This gives rise to exclusion from the tricot-formation process of the needles devoid of inputs or commands; this exclusion which may be complete or per defined regions, produces floating yarns instead of the loops, as Y in FIG. 1.

Consequently, the knitted fabric tube is submitted to a structural deformation caused by a differentiated growing of the knitted fabric as a whole, adapted to preestablish tridimensional shapes of the fabric and suitable to conform to the human anatomy: sock heels and toes; or hips, bust, breasts, etc.

Said floating yarns can be further handled with some working needles duly spaced apart in said region of complete exclusion, with a dual purpose, i.e. that of reducing the floating yarn length and that of creating, if required, important interlacements of stitches.

Then by disposing some working needles in the concerned area and operating in a single or double (crossed) diagonal direction, braid-like effects are obtained, instead of the free floating yarns. This improves both the aspect and wearing quality of the knitted item, having said braids an aesthetic value of great effect, as F in FIG. 3.

The invention is fully carried out by further handling said floating yarns and converting-them into a knitted fabric produced with only part of the needles present in the areas already defined as completely excluded from the tricot-formation process.

In this case the invention is accomplished by sending inputs or information to only part of the needles of the pattern areas previously already excluded, according to an established order.

For instance, only odd needles or only needles in alternating pairs will be excluded, i.e. in groups of three working needles followed by one or more excluded needles, etc.

The simultaneous presence of working needles and loops B, alternated with excluded needles and loops A, FIG. 2, over defined regions and for A relatively long time, (corresponding to a high number of stitch courses) is a sufficient and necessary premise for the production of a new fabric, formed by the working needles and relative loops B, but interrupted and also braided with the excluded needles and loops A, in order to produce a closed or open knitted flounce formed of two layers or cloths B1, FIG. 2, internally of the usual knitted tube. This fabric growing or additional flounce B1 is characterised on the right side of the fabric by a perfect suture caused by elongation of the loops or needle stitches A out of work and therefore excluded from production of said flounce which can be repeated and varied both in height and in width.

In this case, the width is determined by the number of the excluded needles or the periodic entry and exit in the tricot-formation process of one or more needles or other movable elements taking part in tricot formation at the edges or vertical outer limits of the pocket, denoted by S in FIGS. 9 and 10.

The method hereinbefore described is shown in FIG. 4, referred to a sports sock 1, seen laterally, with the usual elastic top 2. In this case said flounce B1 formed of two layers or cloths 5 and 6, is placed internally of the knitted tube 4 and extends from top to bottom, i.e. from the work circumference 7, being only partly interstitched with the outer knitted tube 4, until 8, i.e. an inner free welt that can be turned inside out, depending on circumstances.

At the upper portion 7, flounce B1 is interstitched only along half the needle cylinder, therefore the open area becomes a pocket or pouch 3, disposed laterally, having an upper edge B formed of two layers that approximately extends over the second half of said cylinder.

The described configuration is illustrated in a different way in FIG. 6, in which sock 1, slightly pressed at arrows F1 and F2 until it takes a downwardly cone-shaped configuration, shows flounce B1 externally of the knitted tube 4, drawn out of the pocket or pouch 3 of FIG. 4. Interstitched close to the point denoted by X is about half of the inner flounce B1 in FIG. 4, corresponding to the knitted area or interstitched circumference denoted by 7 and therefore opposite to pocket 3.

In FIG. 6, the knitted fabric portion or flounce B1 forming the inner circle W is practically internally of the knitted tube denoted by arrow Y1.

The inner portion of the knitted fabric circle W is produced with a lower number of needles than the outer portion denoted by B1. FIG. 5 shows an embodiment similar to the preceding one, with the difference that sock 1 is provided with a pocket 3 located at the shin and that a small central pattern or ornamental motif is added. FIG. 7 shows sock 1 produced in accordance with the invention with an alternative solution showing the pocket 3 and relative upper edge B turned upwardly.

In this case the inner flounce B2 is turned inside out and up beyond the elastic top 2; the inner welt 8 of FIGS. 4 and 6 is completely turned inside out and up and this alternative solution causes reversal of the position of pocket 3, which is a further hypothesis that, in addition to increasing flexibility of the invention, is particularly useful for other specific knitted items, in addition to socks.

In fact, looking at FIG. 7 in a reversed position, a very wide pocket or pouch may also be obtained which is ideal for knitwear items, with the additional advantage of the elastic top 2. Shown again in FIG. 8 is the same sock 1 of FIG. 5, seen laterally with addition of holes H at the inner flounce B1 interstitched with the outer cloth or layer for about half the needle cylinder, whereas on the remaining part flounce B2 itself, open, forms a pocket 3 completed with the upper edge B.

Said holes H are created by the prolonged exclusion of some needles from the tricot-formation process. Practically, the effects of the pneumatic pulling action of the sock and the tensions of the loops or stitches still retained by the needles are combined together.

The sizes of said holes depend on the machine needles per inch, or gauge, the number of the excluded needles, the exclusion time and employed yarns count. By coordinating in an appropriate manner the various technical-textile factors, it is therefore possible to establish the final effect of holes H. An additional embodiment of the invention is shown in FIG. 8 concerning the anatomic conformation of heel T caused by the inner flounce located at the dashed area N–M coming out of the wide pocket 3 following the direction of the arrows. With the aid of mobile stitch cams controlled by a computer, the knitted fabric can be only widened in order to emphasize the shaping or anatomic conformation effect of the knitted fabric at the heel.

FIG. 9 is a sectional view of the configuration of pocket 3 and related upper edge B, formed of layers or cloths F1 and F2 concentric with the inner fabric F3.

Identified by 3A is a hypothetical additional pocket the width of which is determined by the number of needles employed or by needles, or jacks, or hooks alternatively operating for the purpose, possibly housed in another needle bed. In order to implement the functions or the aesthetic aspect of the knitted item being the object of the invention, one or more floating yarns 7 can be inserted, by known techniques, within the flounce formed of layers F1-F2-F3, FIG. 9. The invention development goes far beyond the hosiery field; in fact, FIG. 10 shows a pair of pants 30 produced with a circular machine of medium diameter with an elastic top 2 and a central pocket 3 delimited at lines S. In accordance with the invention, during knitting, that may indifferently take place either from the elastic top or from the opposite part, the usual work cycle is interrupted by the programmed exclusion of an appropriate number of needles retaining the relative loops, whereas the remaining needle part goes on production. The dashed portion 31 corresponds to the inner flounce which, knitted with appropriate yarns, in accordance with the invention, also performs the functions of an additional aesthetically-invisible body support or containment element.

FIG. 11 shows a different application of the invention concerning a sweater 20 fitted out with a main pocket 3 and a small pocket 3A placed on one of the sleeves, preferably produced with a small diameter circular machine.

The embodiment in FIG. 12 shows a general knitted item 40 characterized by a series of multi-purpose pouch-like pockets, progressively denoted by 3-3A-3B-3C. The item in FIG. 13 on the contrary shows a T-shirt or brassiere provided with two pockets 3, obtained with an electronic circular knitting machine, according to the teachings of the invention.

In addition, these pockets can be further widened and, with the aid of selective stitch-forming cams, i.e. cams only operating at the knitted fabric region corresponding to the breast or pockets, the amount of stitches can be increased and the knitted fabric conformation can be modified in order to stress the shaping or anatomic conformation effect obtained by turning the inner fabric inside out, in the same manner as previously described for heel T in FIG. 8.

The embodiment in FIG. 14 refers to a body stocking 50 fitted with a central pocket 3 produced in accordance with the present invention and obtained from an inner flounce 58, as wide as area 55. In this embodiment too the presence of one or more additional flounces 57 is provided and can be turned inside out or movable according to arrow F.

The relative band 56, knitted with elastomer yarns, becomes a region for invisible anatomic support and containment. The knitwear item 70 in FIG. 15 diagrammatically shows a pair of trousers or a skirt fitted with pockets 3 and 3A.

In the case of a skirt 70, the inner flounce 71 duly lengthened or aesthetically enriched with known techniques (appropriate interlacements, yarns or knitted fabric structures) in accordance with the invention, automatically produces an additional cloth having a function of underdress, petticoat or lining, which may be more or less visible or transparent, depending on the user's wishes. For best comprehension of the invention potentialities, some remarks on the presence and function of the previously described flounces are necessary; also because such flounces in other embodiments greatly characterize the knitted items. In fact, a plurality of additional inner flounces are provided, which may be different in height, width and thickness, and obtained by a differentiated growing of the fabric having different functions and aims, for a better comfort and protection.

Finally, increasing the solidity of the pocket object of the invention is possible by means of particular yarns, elastic, or provided with tiny hooks and eyelets, to be used only at the upper edge of said pockets and/or at the immediately-opposite knitted fabric region in order to achieve a better closure of the said pocket.

The wide flexibility of the invention enables the shape and functions of at least part of the present knitwear and hosiery production to be greatly modified, with the effects and results only partly described herein.

The proper use of the reciprocating movement within the scope of the invention also produces other original results such as hems or inner and outer borders, variously disposed.

The advantages of the invention are better emphasized with reference to the single drawings.

In FIG. 1 a structure of jersey knitted fabric is shown with a floating yarn Y produced by the complete absence of needles. FIG. 2 shows a knitted fabric obtained by working needles and loops B alternated with the excluded needles and loops A. This production providing differentiated growing of the knitted fabric produces an inner two-layer flounce B1, seen in section in FIG. 2*a*. This flounce is variable in height and width. In FIG. 3 and 3*a* it is shown, in front sectional view a series of very short floating yarns, corresponding to 3-4-5 needles alternated with selected needles disposed in a double and crossed direction. This interlacing aims at tying the floating yarns Y in FIG. 1 in order to obtain an aesthetically pleasant braid.

In FIG. 4 sock 1 is fitted with an elastic top; flounce B1, formed of cloths 5 and 6, is at the inside of fabric 4. Said flounce is half interstitched by the cylinder needles at 7, whereas the second half is open and forms the side pocket 3, with a two-layer upper edge B. The same sock 1 is further seen in FIG. 6 after taking the inner flounce B1 out of said pocket 3 or turning it inside out. The fabric circle identified by W goes back to the inside of the knitted tube 4, in the direction of arrow Y1. In FIG. 5 sock 1 is provided with a front pocket placed at the shin. This pocket, among other things, can be used as a container for plastics shinpads in sport activities or for other purposes requiring strong protection against impacts. An alternative form of pocket 3, which is directed upwardly due to the reversed position of the inner flounce B1, in addition to the elastic top 2 is shown in FIG. 7.

Sock 1, shown in FIG. 8, represents a pocket or pouch 3 which is as wide as half the needle cylinder, whereas the second half of the knitted tube is characterized by a continuous series of horizontal holes H produced by distortion of loops as a result of a prolonged exclusion of the related needles from the tricot-formation process. The sock portion T, corresponding to the heel, is optionally produced in accordance with the invention; thus, the knitted fabric region within dashed lines M–N comprises the already described inner flounce and pocket 3 and the inner cloth partly comes out of it for achieving a wrapping effect.

This is obtained with the aid of computerized stitch cams, which are adapted to modify the loop thickness during tricot formation only for the needles corresponding to heel T. Pocket 3 of the preceding figure in a more diagrammatic manner, formed of cloths F1 and F2 which are opposite to and concentric with the inner cloth F3. Identified by 7 are the floating yarns inserted between the layers of the flounce and/or in the pocket. Identified by S are the outer limits of a hypothetical additional pocket.

Different pockets 3-3A in pants and other knitwear items are shown in FIGS. 10 and 11.

Other embodiments concerning a knitted item with a series of multi-purpose pockets 3-3A-3B-3C, are shown in FIG. 12.

A brassière 60 with two pockets 3 is shown in FIG. 13, which pockets, if very wide, are capable of opening for turning inside out part of the inner cloth 61 thus a high wrapping effect. FIG. 14 shows a body stocking 50 with a central pocket 3 together with inner flounces 57 and 58, at the respective areas 56 and 57, to be widely used for additional effects of targeted anatomic containment. Longer as 71 it is an alternative solution for possible petticoats as in the case of skirt 70 in FIG. 15, also provided with two side pockets 3 and 3A.

The present invention which is necessarily limited, offers wide margins of innovation to those skilled in the art, all falling within the scope of the invention.

What is claimed is:

1. Method for producing three-dimensional knitted goods on a circular knitting machine having at least a needle bed rotating against associated cams or vice versa, comprising the following steps, producing a first length of knitted tube (4), ending with a last stitch course, with the needles of said needle bed; and producing a second length of knitted tube (4) starting from said last stitch course of the first length; characterized in that said step of producing a second length of knitted tube (4) comprises the steps of:

excluding temporarily from the knitting process a predetermined number of said needles, corresponding to a portion of the needle bed, said predetermined number of needles retaining their loops;

producing a first portion of said second length of knitted tube (4) with the remaining needles of said needle bed, starting from said last stitch course of the first length; and reintroducing said predetermined number of excluded needles in the knitting process, after a prefixed time depending on the length of the first portion, to produce a second portion of said second length of knitted tube (4), whereby at least a pocket (3) of multilayer fabrics is automatically obtained on said knitted tube (4) in the area of said first portion of the second length of the knitted tube (4), said pocket (3) consisting in a flounce (B1)produced internally to the usual knitted tube (4) with a continuous rotary motion of the needle bed.

2. Method according to claim 1, characterized in that in said step of producing said first portion of said second length of knitted tube (4), needles excluded from operation are alternate with needles continuously operating whereby, when said excluded needles are brought back into operation, a closed flounce (B1) is formed in, the area of said first portion of said second length of knitted tube (4).

3. A method according to claim 2, characterized by the presence of a pocket or an inner flounce made of a multi-layer fabric, produced by all needles in at least one region and by a reduced number of needles, disposed or selected in an alternating order, such as 1:1-2:2-3:3-3:1 and multiples thereof, in the adjacent regions.

4. A method as claimed in claim 2, characterized by the presence of an inner flounce made of a multi-layer fabric produced by a fixed selection only for some needles such as the odd ones, or by needles in alternating pairs, and then by the simultaneous presence or knitting function of working needles alternated with needles still excluded, over definite regions for relatively long time, producing a two-layer knitted pouch, which is closed or partly open within the usual knitted tube.

5. A method according to claim 1 characterized in that part of the needles or stitches is completely excluded from production in accordance with a pattern or motif converted into pulses or inputs or commands for the needles and according to a defined scheme or program in order to produce floating yarns as an alternative to the stitch, in the excluded knitted fabric portion.

6. A method according to claim 5, characterized in that in the already excluded knitted fabric region, only some needles work for the purpose of interlacing the floating yarns according to a preestablished pattern or production cycle.

7. A method according to claim 5 characterized in that in the already excluded knitted fabric region, only part of the needles work with a fixed selection in the rib direction, in order to produce a knitted flounce on the reverse side of the fabric.

8. A method according to claim 5, characterized in that only one or more needle groups are excluded, for the purpose of forming one or more openings or pockets fitted with two-cloth outer welts.

9. Knitted goods obtained by the steps of:

producing a first length of knitted tube (4), ending with a last stitch course, with the needles of said needle bed; and producing a second length of knitted tube (4) starting from said last stitch course of the first length; characterized in that said step of producing a second length of knitted tube (4) comprises the steps of:

excluding temporarily from the knitting process a predetermined number of said needles, corresponding to a portion of the needle bed, said predetermined number of needles retaining their loops;

producing a first portion of said second length of knitted tube (4) with the remaining needles of said needle bed, starting from said last stitch course of the first length; and reintroducing said predetermined number of excluded needles in the knitting process, after a prefixed time depending on the length of the first portion, to produce a second portion of said second length of knitted tube (4), whereby at least a pocket (3) of multilayer fabrics is automatically obtained on said knitted tube (4) in the area of said first portion of the second length of the knitted tube (4), said pocket (3) consisting in a flounce (B1) produced internally of the usual knitted tube (4) with a continuous rotary motion of the needle bed.

10. A knitted good according to claim 9, characterized by the presence of an inner multi-layer knitted fabric susceptible of being repeated and varied both in height and width, and partially open to form a pocket.

11. A knitted good according to claim 9, characterized by the presence of one inner knitted fabric flounce forming a closed knitted fabric ring, B1 which is partly interstitched at least at one of its ends.

12. A knitted good according to claim 9, characterized by the presence of one inner multilayer flounce having the function of an inner lining or an outer accessory.

13. A knitted good according to claim 9 characterized by the presence of at least one pocket placed at a region where there are two or more concentric cloths or flounce that can be also turned inside out.

* * * * *